US006682012B1

(12) United States Patent
Parviainen et al.

(10) Patent No.: US 6,682,012 B1
(45) Date of Patent: Jan. 27, 2004

(54) EQUIPMENT AND METHOD IN HANDLING OF DOCTOR BLADES FOR A PAPER/ CARDBOARD MACHINE

(75) Inventors: Seppo Parviainen, Jyväskylä (FI); Mika Häkkinen, Otava (FI); Sami Kuparinen, Mikkeli (FI); Ilkka Eskelinen, Jyskä (FI); Ilkka Rata, Jyväskylä (FI); Harri Ruotsalainen, Varkaus (FI); Heikki Toivanen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/019,982

(22) PCT Filed: Jun. 15, 2000

(86) PCT No.: PCT/FI00/00539

§ 371 (c)(1),
(2), (4) Date: Apr. 22, 2002

(87) PCT Pub. No.: WO01/04414

PCT Pub. Date: Jan. 18, 2001

(30) Foreign Application Priority Data

Jul. 9, 1999 (FI) ..... 991578

(51) Int. Cl.[7] ..... B65H 18/04; B65H 18/10

(52) U.S. Cl. ..... 242/528; 242/539; 242/546.1; 242/597.8

(58) Field of Search ..... 242/403, 407, 242/528, 532, 532.5, 533.8, 539, 546.1, 548, 537, 548.2, 395, 579, 586, 597.8; 29/403.3, 426.4, 402.08

(56) References Cited

U.S. PATENT DOCUMENTS

| | | | | |
|---|---|---|---|---|
| 3,318,443 A | * | 5/1967 | Hillis | 242/588.6 |
| 3,768,748 A | * | 10/1973 | Pfefer | 242/538.4 |
| 3,795,370 A | * | 3/1974 | Dean | 242/536 |
| 3,810,588 A | | 5/1974 | Mahoney | |
| 4,396,165 A | * | 8/1983 | Bates et al. | 242/532.6 |
| 5,264,035 A | | 11/1993 | Beisswanger et al. | |
| 5,305,965 A | * | 4/1994 | Yamada et al. | 242/523.1 |
| 5,566,901 A | * | 10/1996 | Wilder | 242/532.6 |
| 5,636,811 A | * | 6/1997 | Crowther et al. | 242/535 |
| 5,849,158 A | | 12/1998 | Costello et al. | |
| 6,027,066 A | * | 2/2000 | Street | 242/532.5 |
| 6,068,272 A | | 5/2000 | Eskelinen | |

FOREIGN PATENT DOCUMENTS

| | | | |
|---|---|---|---|
| FI | 3395 | 12/1997 | |
| FI | 980148 | 1/1998 | |
| FI | 980514 | 6/1998 | |
| GB | 2175572 A | * 12/1986 | B65H/19/12 |

OTHER PUBLICATIONS

U.S. patent application No. 09/263,397.

* cited by examiner

*Primary Examiner*—Kathy Matecki
*Assistant Examiner*—Scott J. Haugland
(74) *Attorney, Agent, or Firm*—Stiennon & Stiennon

(57) ABSTRACT

A reeling device (10), has a support base (1), a support arm (2), and a shaft (9') mounted on the support arm (2). One shaft end has a boss (9) and the other end has a revolving frame (7). Mounted to the device is a transit case (20), within which the used doctor blades (12) of a paper/cardboard machine are reeled on a roll. Raw material is supplied to a blade production plant, where the blades are produced, then transported to a paper/cardboard plant and stored in the plant prior to being mounted in connection with paper/cardboard machine rolls, where their condition is monitored during use. Used doctor blades are removed from the machine, packed in storable form with the reeling device, and are stored in the paper/cardboard plant. The packed used blades are transported away from the paper/cardboard plant and delivered into recycling, reuse or end use.

16 Claims, 3 Drawing Sheets

EQUIPMENT AND METHOD IN HANDLING OF DOCTOR BLADES FOR A PAPER/ CARDBOARD MACHINE

CROSS REFERENCES TO RELATED APPLICATIONS

This application is a U.S. national stage application of International Application No. PCT/FI00/00539, filed Jun. 15, 2000, and claims priority on Finnish Application No. 991578, Filed Jul. 9, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an equipment for reeling used doctor blades to be in storable form for reuse, after-treatment or recycling.

The invention also relates to a method for handling doctor blades for a paper/cardboard machine, comprising the steps of supplying the raw material for doctor blades to the doctor blade production plant, producing the doctor blades in the doctor blade production plant, transporting the doctor blades to the paper/cardboard plant, storing the doctor blades in the paper/cardboard plant prior to introduction to use, mounting the doctor blades to be in connection with paper/cardboard machine rolls, monitoring the condition of doctor blades during the use, and removing the used doctor blades from the paper/cardboard machine.

The doctor blade is an important component in securing the performance of the paper/cardboard machine, which in connection with the roll maintains the condition of the roll face and permits the passing of the web portion that is to be passed into the pulper out of the connection with the roll. Doctor blades are made of different materials, such as steel, glass fibre laminate, carbon fibre laminate and other composite materials. Different materials are needed because doctor blades are used in connection with rolls of different structure groups of paper/cardboard machine, from the wire section to the finishing room, because of which the requirements vary concerning an optimally performing doctor blade. Doctor blades made from certain materials can be reused, e.g. carbon fibre laminate blades of the press section can be reused in the dryer section. After the first use, the doctor blade is cleaned, cut to be of uniform width, sharpened, packed and conveyed to a new target.

For the present, it is more common to cut used doctor blades removed from paper machines into pieces and destroy as residue rather than reuse them. One reason thereto is that the handling of doctor blades is difficult. It is known in the art to reel used doctor blades manually on a roll on the floor and to place them one by one into cardboard boxes used for transporting. There is a risk to have incised wounds when reeling by hand, and moreover, reeling by hand has to be carried out in a most unergonomical position.

For handling doctor blades prior to introduction to use, various designs have been developed. An equipment and a method in handling doctor blades is disclosed in application FI-980514, in which doctor blade blanks are picked from a doctor blade roll and cut off in a cut-off device into a desired length, whereafter a doctor blade is mounted in a paper machine for use. Application No. FI-980148 introduces a storage case for doctor blades in which the doctor blade material is stored as a roll before use. The utility model FIU3395 introduces furthermore a carriage in which doctor blade cases are stored and transported for use.

SUMMARY OF THE INVENTION

The object of the present invention is to produce an equipment for storing used doctor blades into a form appropriate for storing and transporting.

A further object of the invention is to produce an equipment for removing used doctor blades from the paper/cardboard machine safely and ergonomically.

One further object of the invention is to provide a method with which used doctor blades can be stored, transported and reused.

The equipment of the invention for reeling used doctor blades to be in storable form is characterized in that the equipment comprises a reeling device provided with a support base, a support arm, a shaft mounted on the support arm, one end whereof being provided with a boss and the other end with a revolving frame, and a transit case, into which the used doctor blades can be reeled on a roll.

The method of the invention for handling doctor blades is characterized in that the method comprises the steps of:

- packing the used doctor blades to be in storable form with the aid of a reeling device,
- storing the used doctor blades in the paper/cardboard plant,
- transporting the used doctor blades away from the paper/cardboard plant, and
- delivering the used doctor blades into recycling, reuse or end use.

BRIEF DESCRIPTION OF THE DRAWINGS

The invention is described below referring to the accompanying drawings in which.

DESCRIPTION OF THE PREFERRED EMBODIMENTS

Figure 1:
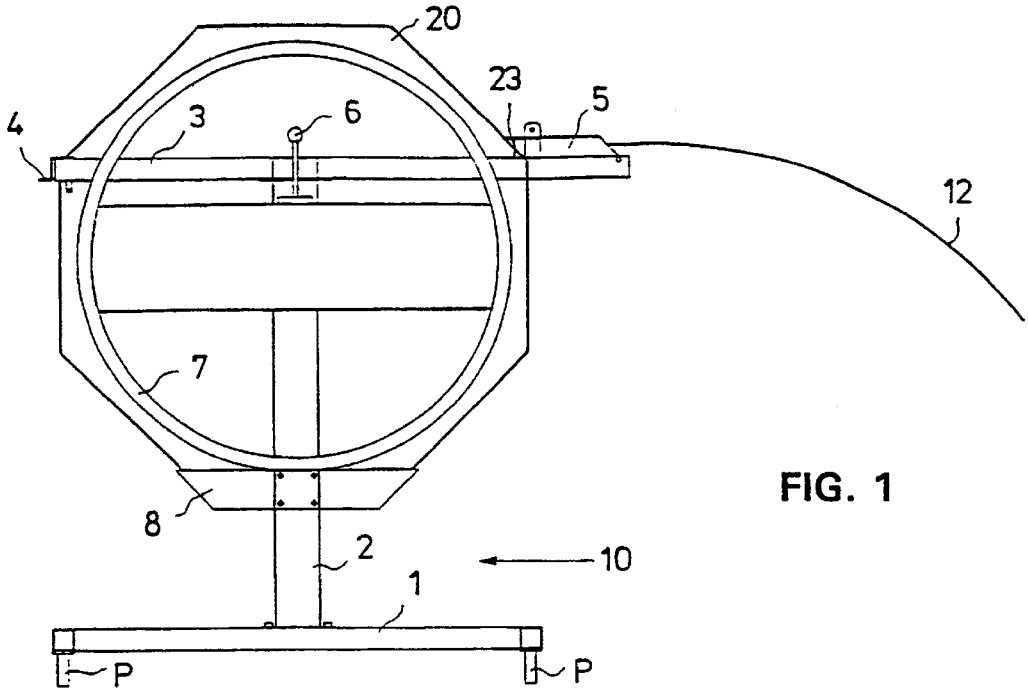
FIG. 1 presents an equipment according to the invention for reeling used doctor blades in front view.
Figure 2:
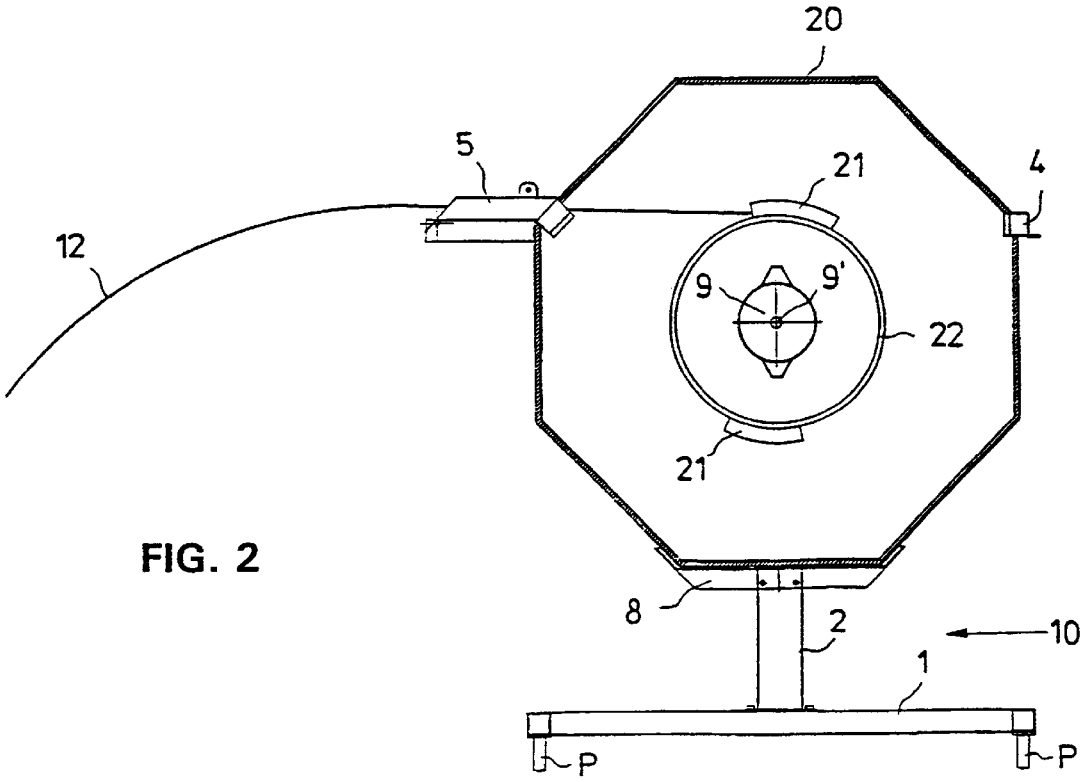
FIG. 2 presents the equipment according to the invention in rear view.
Figure 3:
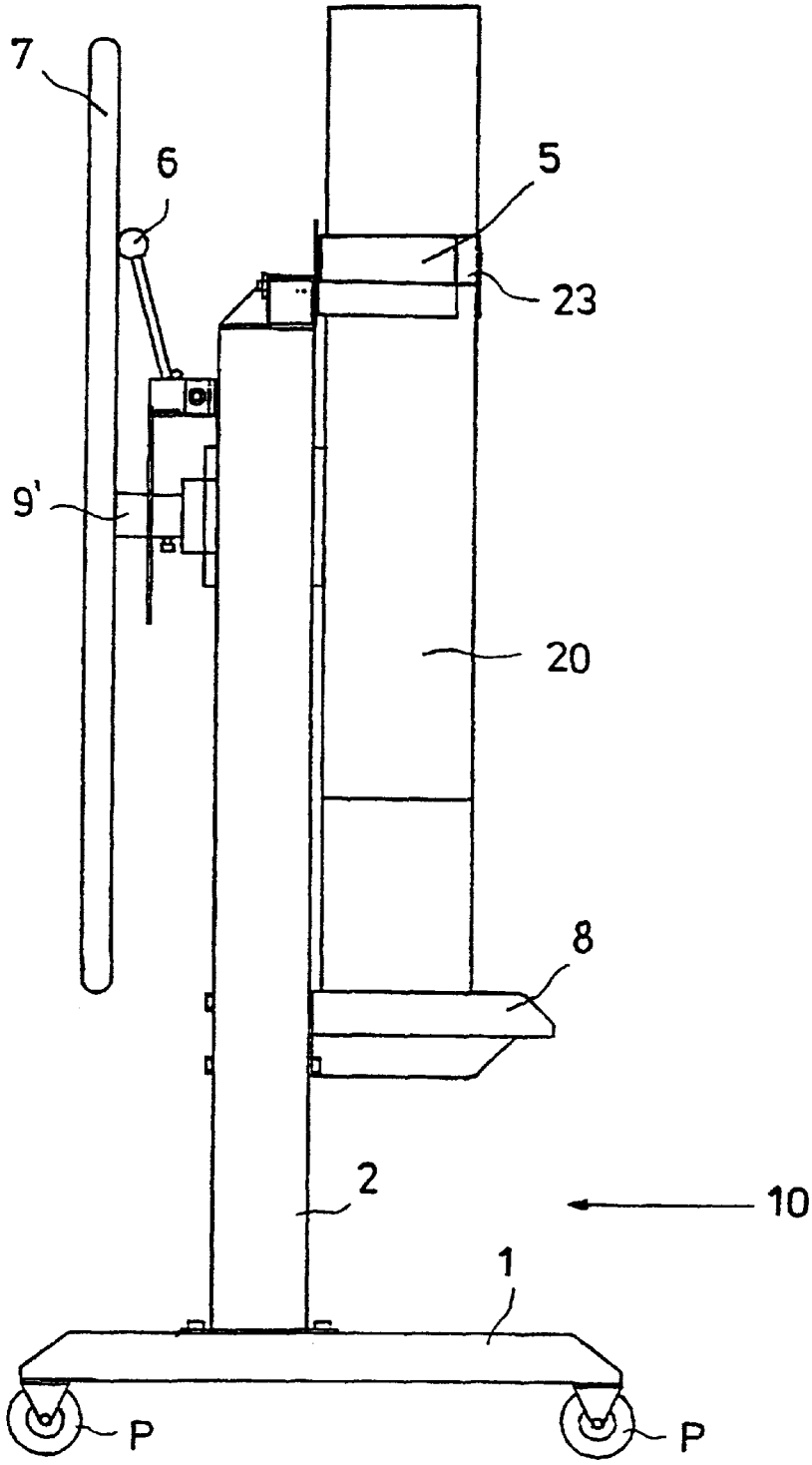
FIG. 3 presents the equipment according to the invention in lateral view.

In FIGS. 1 to 3, the equipment according to the invention for handling used doctor blades is presented in front, rear and lateral views. The equipment according to the invention comprises a reeling device 10 and a transit case 20 for doctor blades. The reeling device 10 is provided with a support base 1, advantageously provided with wheels P. On the support base 1, a support arm 2 has been mounted which is provided with a support 8 for placing and supporting the transit case 20 in the reeling device 10. In the upper part of the support arm 2, there is provided a mounting on the shaft 9' of the boss 9, which can be locked in place with a locking member 6. On the other end of the shaft 9' of the boss 9, a revolving frame 7 is mounted for reeling a doctor blade 12 into the transit case 20.

The transit case 20 comprises a reeling core 22, which can be disposed around the boss 9 of the reeling device 10. As to the shape, the transit case 20 can be e.g. polygonal, like the one seen in FIGS. 1 and 2, or of some other shape. The material of the transit case 20 is e.g. plastic or corrugated cardboard. The reeling core 22 of the transit case 20 is provided with fixing members 21 for fixing the end of the doctor blade 12 to the reeling core 22. The side wall of the transit case 20 includes an aperture 23 or alternatively a weakening or perforation for making an aperture, through which aperture 23 the doctor blade 12 is guided into the transit case 20.

On the upper end of the support arm 2, a transversal upper arm 3 is mounted, being provided with a guide 5 for fastening the transport case 20 and for guiding the doctor blade 12 into the transit case 20, and a bolt 4 at the other end for fastening the transit case 20 to the reeling device 10.

A doctor blade 12 is taken to the reeling device 10 so that its head is pushed through aperture 23 in the transit case 20 with the aid of the guide 5, so that the end of the doctor blade 12 is fastened to the fixing member 21 provided in the transit case 20 and is automatically locked therewith. The reeling-in of the doctor blade 12 is carried out by rotating the revolving frame 7.

After reeling one doctor blade, the next doctor blade can be attached to the previous one by fixing its first end to the latter end of the preceding with an appropriate fixing means, such as bundling tie. The last doctor blade to be reeled into the transit case 20 is reeled entirely into the transit case 20. After the reeling, the transit case 20 is detached from the reeling device 10 by opening the bolt 4 and the guide 5. The subsequent empty transit case 20 is mounted in the reeling device 10 by lifting the transit case 20 on top of a support 8 and by fastening the guide 5 and the bolt 4.

The reeling device 10 of doctor blades can be manually operated, whereby the revolving frame 7 is rotated manually. The device 10 can also be provided with a motor to facilitate the reeling.

The support arm 2 of the reeling device 10 can be fixed in height or the support arm 2 can be provided with a height regulator so that the utilization of the reeling device 10 can be more varied.

Also, the fastening of the support 8 can be made adjustable on different heights so that transit cases of different sizes can be used. In this case, the length of the upper arm 3 can also be adjusted.

Figure 4:
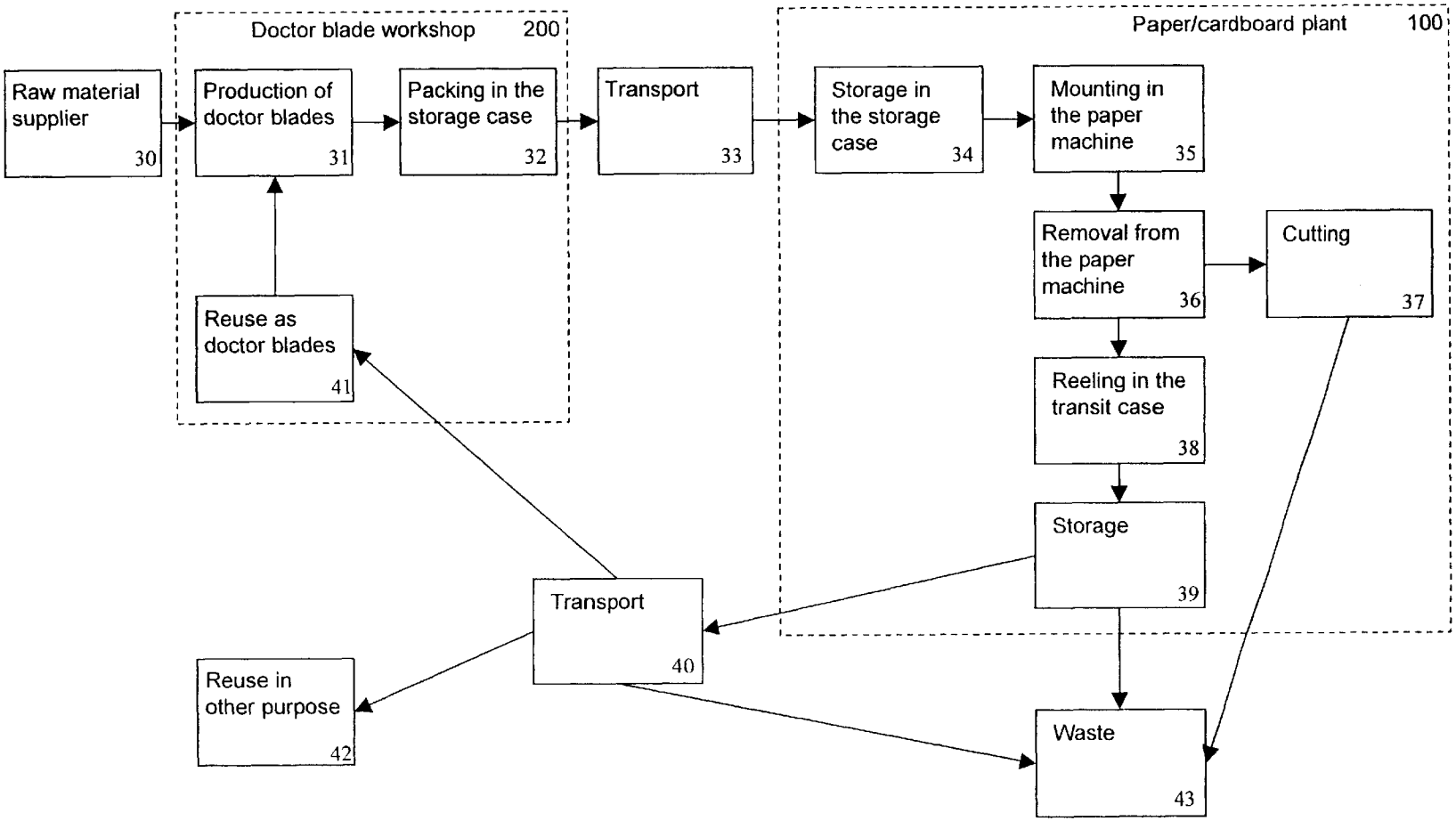
FIG. 4 presents a block diagram of the different steps of the product life cycle of the doctor blades for a paper/cardboard machine.

FIG. 4 shows the product life cycle of doctor blades as a block diagram. The raw material supplier for doctor blades 30 supplies the raw material required to the production plant of doctor blades, that is to a doctor blade workshop 200, where doctor blades are produced (step 31) for the size and length ordered by the client. The doctor blade workshop 200 packs the finished doctor blades or doctor blade blanks e.g. in a storage case for doctor blades disclosed in patent application FI-980142 (step 32). The packed doctor blades are transported (step 33) to a paper/cardboard plant 100 where the doctor blades are stored (step 34) prior to the use.

In conjunction with introduction into use, doctor blades are transported to the unit/roll of the paper machine where they are going to be used and they are mounted into the paper machine (step 35). In the mounting step, the equipment and the method as those introduced in patent application FI-980514 is preferably used in handling doctor blades for a roll in a paper/cardboard machine. In conjunction with the use, the condition of the doctor blade is monitored and after the blade has worn into a certain width or damaged somehow, it is removed from the paper machine (step 36).

After being removed, the doctor blades can be destroyed e.g. by cutting them into pieces of appropriate lengths (step 37) and carrying them into waste thereafter (step 43). A more environmentally friendly alternative is to reel doctor blades into a transit case by means of a doctor blade reeling device according to the invention (step 38), whereafter the doctor blades are stored (step 39) and transported (step 40) away from the paper/cardboard plant 100 for reuse. Doctor blades with sufficient blade width remaining can be reused for the same purpose (step 41) by taking them to the doctor blade workshop 200 where the doctor blades are sharpened again (phase 31) and packed into storage cases (step 32) similar to the way used with new doctor blades.

Used doctor blades can be reused also for purposes other than their original use (step 42). Such purposes could be, e.g.: use in road construction or other building material. The doctor blade material is provided with good breaking strength and flexural strength properties, because of which it is well suited for a number of reuses.

What is claimed is:

1. An equipment for reeling used doctor blades to be in storable form for reuse, after-treatment or recycling of the doctor blades, wherein the equipment comprises:

a reeling device having a support base, a support arm, a shaft mounted on the support arm, one end of the shaft being provided with a boss, and another end of the shaft being provided with a revolving frame;

a transit case into which the used doctor blades can be reeled on a roll;

an upper arm fastened on the support arm, the upper arm having one end which has a guide for guiding the end of the doctor blade into the transit case and the upper arm having another end with a bolt for fastening the transit case to the reeling device; and a support for supporting the transit case to the reeling device.

2. The equipment of claim 1 wherein the support base is provided with wheels.

3. The equipment of claim 1 wherein the reeling device further comprises a locking unit for locking the shaft in place.

4. The equipment of claim 1 wherein the transit case further comprises:

a reeling core provided with free entry to the boss of the reeling device; and a fastening member for fastening the end of the doctor blade to the transit case.

5. A method for handling doctor blades of a paper/cardboard machine, said method comprising the steps of:

supplying raw material for doctor blades to a doctor blade production plant;

producing the doctor blades in the doctor blade production plant;

transporting the doctor blades to a paper/cardboard plant;

mounting the doctor blades to be used in connection with paper/cardboard machine rolls, where after use the doctor blades become used doctor blades;

removing the used doctor blades from the paper/cardboard machine;

packing the used doctor blades in storable form into a transit case according to the following steps:

mounting the transit case to a reeling device having a support base, and a support arm which extends upwardly from the support base, an upper arm being mounted to the support arm, and a guide and a bolt being mounted to the upper arm, the transit case being mounted between a support on the support arm and the bolt;

fastening the transit case to the upper arm with the bolt;

guiding the doctor blades into the transit case with the guide on the upper arm;

mounting the doctor blade to a boss on one end of a shaft mounted for rotation on the support arm;

rotating a revolving frame mounted to the shaft opposite the boss to draw the doctor blade into the transit case guided by the guide on the upper arm;

storing the used doctor blades in the paper/cardboard plant;

transporting the used doctor blades away from the paper/cardboard plant; and delivering the used doctor blades into recycling, reuse or end use.

6. The method of claim 5 wherein the packing step comprises packing a plurality of used doctor blades in one transit case.

7. The method of claim 5 wherein the packing step further comprises attaching consecutive doctor blades to be packed in one transit case to each other with a fixing means.

8. The method of claim 5 further comprising the step of delivering the used doctor blades to the doctor blade production plant for reuse.

9. The method of claim 8 further comprising the step of producing from a used doctor blade a reusable doctor blade in the doctor blade production plant.

10. The method of claim 5 further comprising the step of reusing the used doctor blades in other than papermaking industry.

11. The method of claim 5 further comprising the step of storing the doctor blades in the paper/cardboard plant prior to introduction to use.

12. The method of claim 5 further comprising the step of monitoring the condition of doctor blades during the use.

13. The method of claim 5 wherein a reeling core is disposed around the boss and the doctor blade is mounted to the boss by way of the reeling core.

14. An apparatus for reeling used doctor blades to be in storable form for reuse, after-treatment or recycling of the doctor blades, the apparatus comprising:

a support base;

a support arm extending upwardly from the support base;

a transit case detachably supported on the support arm, the transit case having a volume into which the used doctor blades can be reeled on a roll;

an upper arm fastened on an end of the support arm;

a guide mounted on the upper arm, the guide for guiding the end of the doctor blade into the transit case;

a bolt on the upper arm fastening the transit case to the reeling device; and a support mounted to the support arm, the support for supporting the transit case to the reeling device;

a shaft extending from the support arm and being rotatable thereon;

a revolving frame fixed to a first end of the shaft; and a boss attached to a second end of the shaft.

15. The apparatus of claim 14 further comprising portions of the transit case defining an aperture through which doctor blades are receivable into the transit case volume.

16. The apparatus of claim 14 further comprising:

a reeling core within the transit case, the reeling core being mounted to the boss to rotate with the shaft;

a first used doctor blade fastened to the reeling core, and wound about the reeling core; and a second used doctor blade fixed to the first doctor blade and reeled into the transit case on the reeling core.

* * * * *